US011808128B2

(12) United States Patent
Phatak et al.

(10) Patent No.: US 11,808,128 B2
(45) Date of Patent: Nov. 7, 2023

(54) SYSTEMS AND METHODS OF INITIATING ENERGETIC REACTIONS FOR RESERVOIR STIMULATION

(71) Applicant: Schlumberger Technology Corporation, Sugar Land, TX (US)

(72) Inventors: Alhad Phatak, Stafford, TX (US); Garud Bindiganavale Sridhar, Sugar Land, TX (US); Douglas Pipchuk, Calgary (CA); Dmitriy Potapenko, Sugar Land, TX (US); Dean Michael Willberg, Tucson, AZ (US); James Ernest Brown, Fort Collins, CO (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 122 days.

(21) Appl. No.: 17/208,729

(22) Filed: Mar. 22, 2021

(65) Prior Publication Data

US 2021/0207466 A1 Jul. 8, 2021

Related U.S. Application Data

(62) Division of application No. 15/818,198, filed on Nov. 20, 2017, now Pat. No. 10,954,771.

(51) Int. Cl.
*E21B 43/263* (2006.01)
*E21B 43/267* (2006.01)
(Continued)

(52) U.S. Cl.
CPC ..... *E21B 43/263* (2013.01); *E21B 36/008* (2013.01); *E21B 43/248* (2013.01); *E21B 43/267* (2013.01)

(58) Field of Classification Search
CPC ..... E21B 43/263; E21B 36/008; E21B 43/267
See application file for complete search history.

(56) References Cited

U.S. PATENT DOCUMENTS 3,937,283 A 2/1976 Blauer et al.
4,030,549 A 6/1977 Bouck
(Continued)

FOREIGN PATENT DOCUMENTS

CA 1144064 A 4/1983
CA 1210322 A 8/1986
(Continued)

OTHER PUBLICATIONS

Wang et. al., "Thermite reactions: their utilization in the synthesis and processing of materials", Journal of Materials Science, Jan. 1993, vol. 28, Issue 14, p. 3693-3708.
(Continued)

*Primary Examiner* — Silvana C Runyan
(74) *Attorney, Agent, or Firm* — Rushi C. Sukhavasi

(57) ABSTRACT

Methods for initiating chemical reactions in a wellbore include delivering one or more reactive components via a carrier fluid to the wellbore. The one or more reactive components delivered to the wellbore are configured to enable one or more chemical reactions to occur. The one or more chemical reactions are carried out until a threshold volume of the one or more reactive components is delivered to the wellbore.

12 Claims, 8 Drawing Sheets

(51) Int. Cl.
*E21B 43/248* (2006.01)
*E21B 36/00* (2006.01)

(56) References Cited

U.S. PATENT DOCUMENTS

| | | | | |
|---|---|---|---|---|
| 4,484,630 | A | 11/1984 | Chung | |
| 4,823,875 | A | 4/1989 | Hill | |
| 5,005,645 | A | 4/1991 | Jennings, Jr. et al. | |
| 5,518,996 | A | 5/1996 | Maroy et al. | |
| 5,905,468 | A | 5/1999 | Ikawa et al. | |
| 6,626,991 | B1 | 9/2003 | Drochon et al. | |
| 6,874,578 | B1 | 4/2005 | Garnier et al. | |
| 6,885,918 | B2 | 4/2005 | Harmon et al. | |
| 7,134,492 | B2 | 11/2006 | Willberg et al. | |
| 7,255,169 | B2 | 8/2007 | van Batenburg et al. | |
| 7,275,596 | B2 | 10/2007 | Willberg et al. | |
| 7,393,423 | B2 | 7/2008 | Liu | |
| 7,581,590 | B2 | 9/2009 | Lesko et al. | |
| 7,775,279 | B2 | 8/2010 | Marya et al. | |
| 7,784,541 | B2 | 8/2010 | Hartman et al. | |
| 7,789,146 | B2 | 9/2010 | Panga et al. | |
| 7,879,721 | B2 | 2/2011 | Gangopadhyay et al. | |
| 8,008,234 | B2 | 8/2011 | Panga et al. | |
| 8,096,361 | B2 | 1/2012 | Willberg | |
| 8,119,574 | B2 | 2/2012 | Panga et al. | |
| 8,210,249 | B2 | 7/2012 | Panga et al. | |
| 8,227,026 | B2 | 7/2012 | McDaniel et al. | |
| 8,234,072 | B2 | 7/2012 | Smith, Jr. et al. | |
| 8,371,383 | B2 | 2/2013 | Bell et al. | |
| 8,685,187 | B2 | 4/2014 | Han et al. | |
| 9,664,018 | B2 | 5/2017 | Vandeponseele et al. | |
| 9,803,457 | B2 | 10/2017 | Shampine et al. | |
| 10,202,833 | B2 | 2/2019 | Willberg et al. | |
| 2006/0081374 | A1* | 4/2006 | Bland | E21B 36/008 166/302 |
| 2007/0267191 | A1 | 11/2007 | Pfeiffer et al. | |
| 2008/0066909 | A1 | 3/2008 | Hutchins et al. | |
| 2008/0196896 | A1 | 8/2008 | Bustos et al. | |
| 2008/0283241 | A1 | 11/2008 | Kaminsky et al. | |
| 2009/0048126 | A1* | 2/2009 | Phatak | C09K 8/685 507/209 |
| 2009/0159286 | A1 | 6/2009 | Prouvost et al. | |
| 2010/0004145 | A1* | 1/2010 | Horton | C09K 8/54 507/224 |
| 2010/0252267 | A1 | 10/2010 | Harris et al. | |
| 2010/0300688 | A1 | 12/2010 | Panga et al. | |
| 2011/0139505 | A1 | 6/2011 | Huang et al. | |
| 2011/0160103 | A1* | 6/2011 | van Zanten | C09K 8/28 507/268 |
| 2012/0000641 | A1 | 1/2012 | Panga et al. | |
| 2012/0111563 | A1 | 5/2012 | Abad et al. | |
| 2012/0132421 | A1 | 5/2012 | Loiseau et al. | |
| 2012/0138296 | A1 | 6/2012 | Panga et al. | |
| 2012/0305245 | A1 | 12/2012 | Loiseau et al. | |
| 2012/0305254 | A1 | 12/2012 | Chen et al. | |
| 2013/0233542 | A1 | 9/2013 | Shampine et al. | |
| 2013/0324444 | A1 | 12/2013 | Lesko et al. | |
| 2014/0078288 | A1 | 3/2014 | Wu | |
| 2014/0262240 | A1 | 9/2014 | Boone et al. | |
| 2014/0262249 | A1 | 9/2014 | Willberg et al. | |
| 2015/0034315 | A1 | 2/2015 | Jiang et al. | |
| 2015/0037234 | A1 | 2/2015 | Jiang et al. | |

FOREIGN PATENT DOCUMENTS

| | | | |
|---|---|---|---|
| CA | 1246994 | A | 12/1988 |
| CA | 2039919 | A1 | 10/1992 |
| CN | 102879801 | A | 1/2013 |
| DE | 512955 | C | 11/1930 |
| DE | 1996317 | U | 11/1968 |
| GB | 2277927 | A | 11/1994 |
| WO | 2009046980 | A1 | 4/2009 |
| WO | 2011050046 | A1 | 4/2011 |
| WO | 2012054456 | A1 | 4/2012 |
| WO | 2013085412 | A1 | 6/2013 |
| WO | 2014116508 | A1 | 7/2014 |

OTHER PUBLICATIONS

Mohler, "Power Independent Ignition Energy Measurements, in Proceedings of the VII International Pyrotechnics Seminar", 1980, pp. 425-435 (accessed via https://archive.org/stream/DTIC_ADA145288/DTIC_ADA145288_djvu.txt).

Pantoya and Granier, "Combustion Behavior of Highly Energetic Thermites: Nano versus Micron Composites", Propellants, Explosives, Pyrotechnics 30 (2005), No. 1, pp. 53-62 (2005).

Ozdemirtas et al., "Innovative Fishbone SAGD Well Pair: An Integrated Approach to Efficienctly Unlock the Resource Potential in Canadian Oil Sands Play", SPE/IADC-173161-MS; SPE/IADC Drilling Conference and Exhibition, Mar. 17-19, 2015, 12 pages.

Section 8-8.1, Fluid loss under static conditions, in Reservoir Stimulation, 3rd Edition, Schlumberger, John Wiley & Sons, Ltd., pp. 8-23 to 8-24, 2000.

Sundaram et. al., "Effects of particle size and pressure on combustion of nano-aluminum particles and liquid water", Combustion and Flame, 160, 10, pp. 2251-2259.

* cited by examiner

SYSTEMS AND METHODS OF INITIATING ENERGETIC REACTIONS FOR RESERVOIR STIMULATION

CROSS-REFERENCE TO RELATED APPLICATIONS

This application is a continuation of co-pending U.S. patent application Ser. No. 15/818,198 filed 20 Nov. 2017, now U.S. Pat. No. 10,954,771, which is herein incorporated by reference.

BACKGROUND

This disclosure relates to stimulation of hydrocarbon production from subterranean formations. More particularly, the present disclosure relates to systems and methods for improving a flow path for hydrocarbons to flow to a wellbore from a formation having low permeability properties using energetic reactions such as thermite reactions.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In some embodiments, a method for initiating a chemical reaction via one or more reactive components in a wellbore is disclosed. The method includes delivering the one or more reactive components via a carrier fluid to the wellbore, wherein the one or more reactive components are configured to enable one or more chemical reactions to occur within one or more fractures of the wellbore, and wherein the carrier fluid is configured to expand, injecting the carrier fluid with one or more dispersants configured to increase the pumpability of the carrier fluid, and carrying out the one or more chemical reactions until a threshold volume of the one or more reactive components is delivered to the wellbore.

In some embodiments, a method for initiating a chemical reaction via one or more reactive components in a wellbore is disclosed. The method includes delivering the one or more reactive components via a carrier fluid to the wellbore, wherein the one or more reactive components are configured to enable one or more chemical reactions to occur within one or more fractures of the wellbore, and wherein the carrier fluid is configured to expand and comprises a salt solution. The method further includes carrying out the one or more chemical reactions until a threshold volume of the one or more reactive components is delivered to the wellbore.

In some embodiments, a method for initiating one or more chemical reactions via one or more reactive components in a wellbore is disclosed. The method includes delivering the one or more reactive components via a carrier fluid to the wellbore, generating electricity in the wellbore, wherein the electricity is configured to cause the one or more reactive components to initiate the one or more chemical reactions, and carrying out the one or more chemical reactions until a threshold volume of the one or more reactive components is delivered to the wellbore.

In some embodiments, a method for initiating one or more chemical reactions via one or more reactive components in a wellbore is disclosed. The method includes delivering the one or more reactive components via a carrier fluid to the wellbore, introducing heat or electromagnetic radiation to the wellbore via one or more fiber optic cables, wherein the fiber optic cables are configured to deliver laser, infrared, microwaves, or other forms of electromagnetic radiation to the one or more reactive components, wherein the electromagnetic radiation is configured to cause the one or more reactive components to initiate the one or more chemical reactions; and carrying out the one or more chemical reactions until a threshold volume of the one or more reactive components is delivered to the wellbore.

In some embodiments, a method for initiating one or more chemical reactions via one or more reactive components in a wellbore is disclosed. The method includes delivering the one or more reactive components to the wellbore, striking the reactive components with a mechanical tool, wherein the mechanical tool is configured to cause the one or more reactive components to initiate the one or more chemical reactions when the one or more reactive components are struck, and carrying out the one or more chemical reactions until a threshold volume of the one or more reactive components is delivered to the wellbore.

In some embodiments, a method for initiating one or more chemical reactions via one or more reactive components in a wellbore is disclosed. The method includes delivering the one or more reactive components to the wellbore, reducing a particle size associated with the one or more reactive components, wherein reducing the particle size of the reactive components increases a reactivity property of the one or more reactive components, and carrying out the one or more chemical reactions until a threshold volume of the one or more reactive components is delivered to the wellbore.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
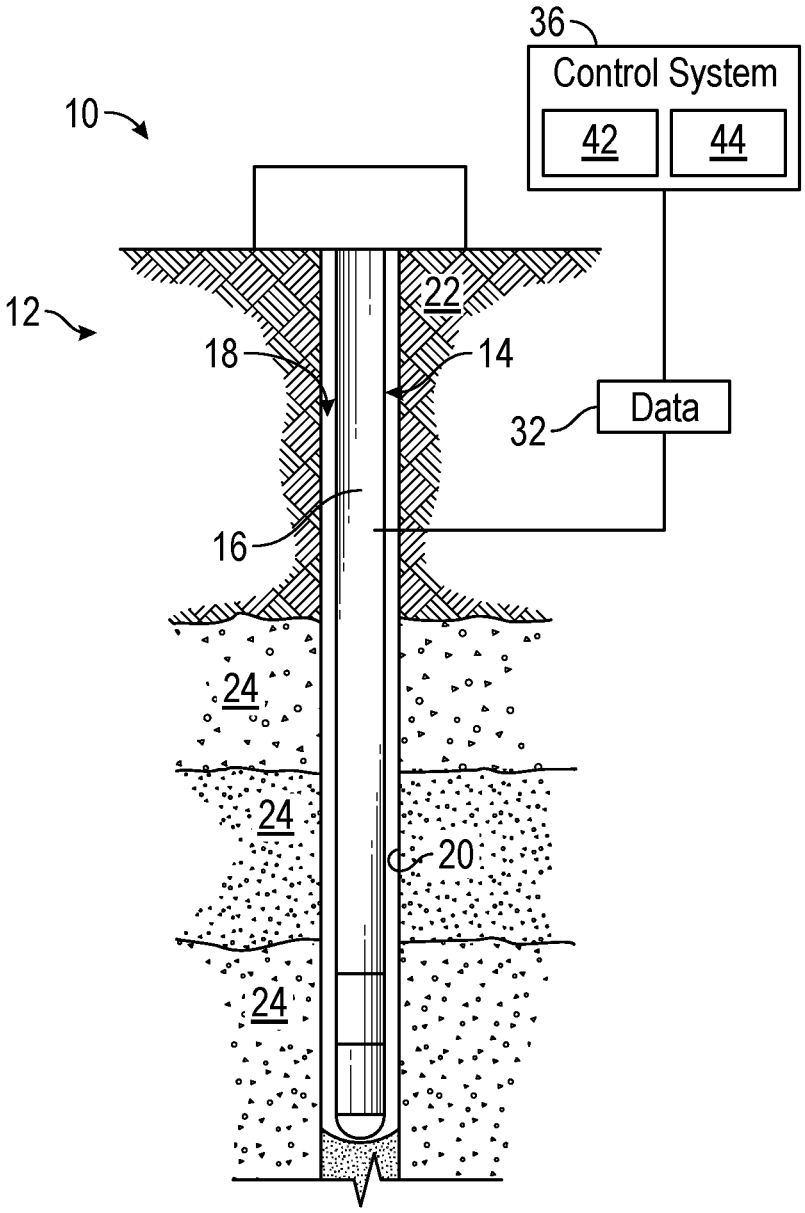
FIG. 1 is a schematic diagram of a well-fracturing system used for stimulating a geological formation, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The following description aims at stimulation of hydrocarbon production from subterranean formations. The following description relates to improving the flow path for hydrocarbons to flow to a wellbore from a formation having low permeability using an exothermic reaction to create a region of fractured rock, such as a region of high permeability fractures and channels, and then connecting this region to a wellbore.

Hydraulic fracturing is a process for improving well productivity by placing or extending highly conductive fractures from a wellbore into the reservoir. Conventional hydraulic fracturing treatments may include pumping various fracturing fluids into a wellbore in several distinct stages. During the first stage, sometimes referred to as a pad, a carrier fluid is injected through a wellbore into a subterranean formation at certain rates and pressures. Here, the fluid injection rate may exceed the filtration rate (also called the leakoff rate) into the formation to increase hydraulic pressure of the injected fluids (e.g., the carrier fluid, a fracturing fluid). When the hydraulic pressure exceeds a threshold value, the subterranean formations crack and fracture. As such, the hydraulic fracture process initiates and the fracturing fluids start to flow into the formation as injection of the fracturing fluid continues. The fracturing fluid may enable fractures in the formation to remain open using propping agents such as sand or synthetic propping agents, thereby enabling production of hydrocarbons as the formation fluid (e.g., hydrocarbon-containing fluid) flows from the formation to the wellbore.

The rate and extent of production of formation fluids (e.g., hydrocarbons) depends upon a number of parameters, such as formation permeability, proppant pack permeability, hydraulic pressure in the formation, properties of the production fluid, the geometry of the fracture, etc. Typically, a single fracture is formed, though multiple fractures are possible and methods have been developed to promote the creation of multiple fractures. However, the rate and extent of hydrocarbon production could be further increased if the volume of the fractures is increased and the fractures are better connected to the wellbore.

With this in mind, the present disclosure relates to systems and methods for delivery of reactive components (e.g., thermites) to a target area in a geological formation to stimulate the geological formation penetrated by a wellbore, as explained further with reference to FIGS. 1-5. In one embodiment, the reactive components (e.g., thermites) may be combusted to initiate an exothermic reaction (e.g., a thermite reaction) that expands a volume of the fracturing fluid (e.g., the fluid including at least the reactive components and a proppant). The exothermic reaction (e.g., the thermite reaction) may then open the hydraulic fractures to increase hydrocarbon production, as explained further with reference to FIGS. 6-14. As such, the systems and methods described herein involve fracturing the formation while introducing fluids (e.g., slurry mixture containing fracturing fluid, reactive components such as thermites, and a proppant) into the fracture and igniting reactive components (e.g., thermites) within or near the fracture to produce a thermite-affected region. Stimulating the geological formation in accordance with the systems and methods described herein may reduce the overall surface footprint of the wellsite by reducing the amount of surface machinery (e.g., pumps) required to pump the fracturing fluid into the wellbore to stimulate and/or create the fractures in the surrounding geological formation. Moreover, the energy associated with conventional fracturing methods may be improved by creating and/or opening the fractures in part via the reactive components (e.g., thermites). Moreover, the volume of fracturing fluid required to achieve a certain fracture geometry in the geological formation may be significantly reduced by using this approach.

The present disclosure also relates to systems and methods for improving the flow of the slurry by introducing one or more dispersants to the slurry mixture to improve the pumpability of the slurry mixture. By employing dispersants in the slurry mixture, the reactive components (e.g., thermites) may be dispersed more evenly throughout the slurry mixture. As such, the reactive components (e.g., thermites) may be ignited throughout the volume of the slurry mixture and may contribute to a greater volumetric expansion of the slurry mixture to further open the surrounding fractures. Still further, the present disclosure relates to systems and methods for adjusting the composition of the slurry mixture, as explained further with reference to Tables 1-2. As may be appreciated, utilizing certain fluids (e.g., water) as the carrier fluid to transport the slurry mixture into the wellbore may reduce the heat generated by the exothermic, thermite reactions. Reducing the heat generated by the exothermic, thermite reactions may reduce the propagation of the thermite reactions, thereby reducing the desired effect of the volumetric expansion of the slurry mixture as the thermite reaction propagates. As such, the systems and methods described herein involve utilizing salt solutions such as zinc-halide or zinc-complexed solutions (e.g., saturated zinc bromide solutions, saturated zinc chloride solutions) as carrier fluids that may enable the heat released by the exothermic thermite reaction to remain in the slurry mixture longer, which may contribute to the thermite reaction propagating longer.

As used herein, the terms "treatment fluid" or "wellbore treatment fluid" are inclusive of "fracturing fluid" or "treatment slurry" and should be understood broadly. These may be or include a liquid, a solid, a gas, and combinations thereof, as will be appreciated by those skilled in the art. A treatment fluid may take the form of a solution, an emulsion, a foam, a slurry, or any other form as will be appreciated by those skilled in the art. As used herein, "slurry" refers to an optionally flowable mixture of particles dispersed in a fluid carrier.

Delivery of Reactive Components to Target Area

Referring now to FIG. 1, an example of a tool for delivering reactive components and other techniques described herein is detailed. However, it should be noted that the systems and methods described in the present disclosure may be implemented in a number of other suitable systems. FIG. 1 illustrates a well perforating and stimulating system 10 that may include a downhole tool 12 deployed on a tubing string 14, such as a coiled tubing string having coiled tubing 16. The tubing string 14 may include a variety of additional and/or alternate components, depending in part on the specific perforating and stimulating application, the geological characteristics, and the well type. In one embodiment, the tubing string 14 is deployed in a wellbore 18 and within a casing 20.

In the illustrated example, the wellbore 18 extends down through a subterranean formation 22 having a number of well zones 24. Each of the well zones 24 may be selectively perforated to form a plurality of perforations 26. Additionally, each of the well zones 24 may be stimulated (e.g., fractured) via an appropriate stimulation operation following perforation of the well zone 24. After the casing 20 is perforated, fracturing fluids may be pumped into the perforations to induce the creation of one or more hydraulic fractures 30 within the respective well zone 24. The hydraulic fractures 30 may then connect the wellbore 18 to a hydrocarbon reservoir, such that the well system 10 may produce hydrocarbons. As mentioned above, in certain parts of the world where the vertical stress profile of the subterranean formation 22 includes a number of different stress regimes or values, the depths in which the perforations are placed may affect the productivity of hydrocarbon production.

The downhole tool 12 may provide measurements 32 to a control system 36 via any suitable telemetry (e.g., via electrical signals pulsed through the subterranean formation 22 or via mud pulse telemetry). To this end, the control system 36 thus may be any electronic control system that can be used to carry out the systems and methods of this disclosure. For example, the control system 36 may include a processor 40, which may execute instructions stored in memory 42 and/or storage 44. As such, the memory 42 and/or the storage 44 of the control system 36 may be any suitable article of manufacture that can store the instructions. The memory 42 and/or the storage 44 may be ROM memory, random-access memory (RAM), flash memory, an optical storage medium, or a hard disk drive, to name a few examples.

As will be discussed in more detail below, the control system36 (or processing circuitry of the downhole tool 12) may use the measurements 32 (e.g., density, chemical reactivity, and/or viscosity, etc.) to adjust the composition of the fluid (e.g., slurry containing fracturing fluid, reactive components, and proppant). With the foregoing in mind, the control system 36 may be used to control an amount of the reactive components (e.g., thermites) that react and release heat, thereby expanding the fracturing fluid and increasing its volume. As may be appreciated, the expansion of the fracturing fluid may generate more fractures in the geological formation and/or open existing fractures to enable greater hydrocarbon production.

The expansion of the fracturing fluid may be accomplished by utilizing thermite reactions. As may be appreciated, thermite reactions refer to a broad class of exothermic reduction-oxidation reactions of metals with metal oxides of less reactive metals. For example, the metals may include aluminum, magnesium, calcium, zirconium, and zinc, among others. The metal oxides may include iron, copper, nickel, titanium, molybdenum, manganese, silicon, and chromium, among others. In other embodiments, the thermite reaction may be initiated by first reacting non-metallic fuels (e.g., explosives, hydrocarbons, etc.) and oxidizers (e.g., persulfates, perchlorates, bromates, permanganates, peroxides, etc.). When ignited, the components may release a large amount of heat that may be used to volumetrically expand the fracturing fluid, thereby opening the fractures in the geological formation for receiving proppants and/or increasing hydrocarbon production.

It may be appreciated that the reactive components may react in a series of reactions. For example, a chemical reaction may first occur between the reactive components (e.g., hydrocarbons and oxidizers). The heat of the chemical reaction may enable a second reaction to occur (e.g., the thermite reaction). The thermite reaction may be highly exothermic and cause the fracturing fluid to expand in the wellbore, thereby opening the hydraulic fractures. Igniting the reactive components (e.g., thermites) may further expand the fracturing fluid.

Figure 2:
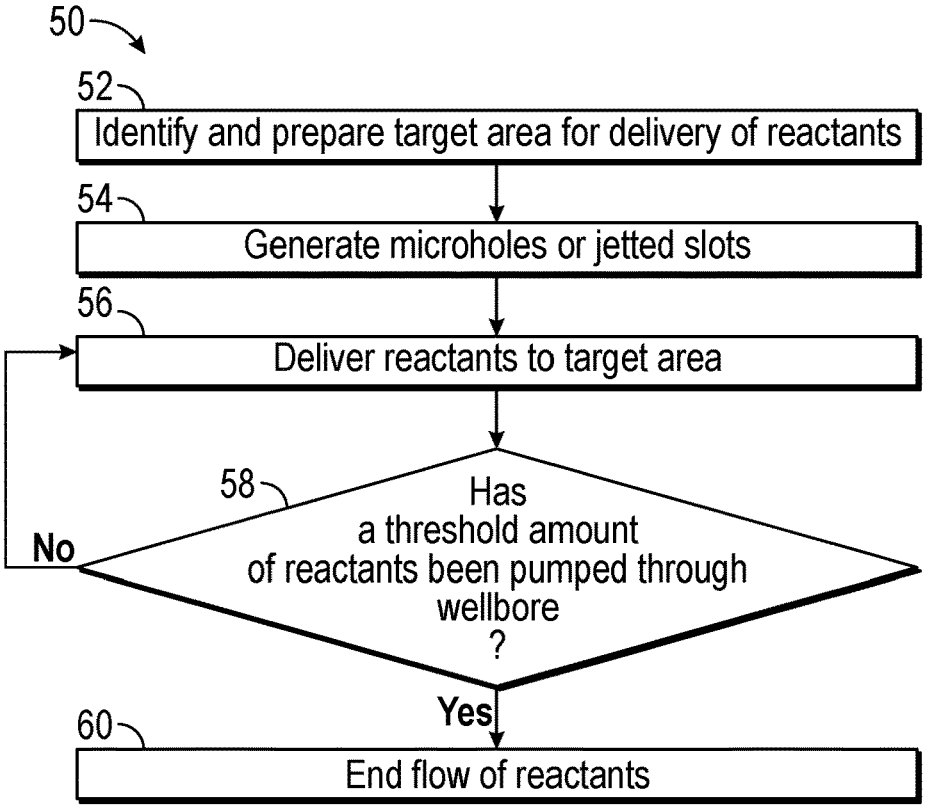
FIG. 2 is a flowchart illustrating a process for delivering reactive components to a target area, in accordance with an embodiment.
Figure 3:
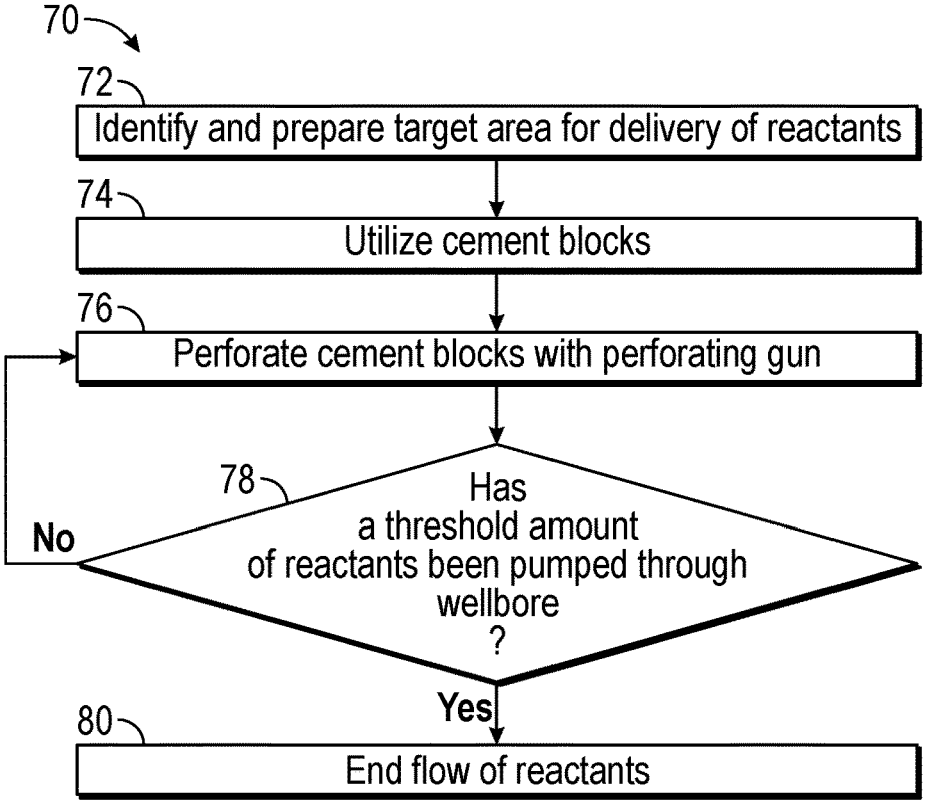
FIG. 3 is a flowchart illustrating another process for delivering reactive components to a target area, in accordance with an embodiment

FIGS. 2-3 describe processes for identifying a target area for delivery of chemical reactants in the downhole tool. FIG. 2 describes a process 50 for identifying a target area and enabling connectivity between the subterranean formation 22 and the wellbore 18. The process 50 includes identifying (block 52) a target area for the reactive components (e.g., metals and oxidizers, non-metallic fuels and oxidizers, etc.) to be delivered to the reaction site from the surface. The process 50 may then include preparing a target area for receiving the reactive components. Preparing the target area may include generating (block 54) microholes or jetted slots. It may be appreciated that the diameter of the microholes may range from approximately 6.35 millimeters (mm) to 127 mm (i.e., 0.25 inches (in.) to 5 in.) while the length of the microholes may range from approximately 3.05 meters (m) to 15.24 m (i.e., 10 feet (ft.) to 50 ft.). Preparing the target area by generating microholes may enable connectivity between a stimulated volume of the subterranean formation 22 and the wellbore 18. That is, connectivity between stimulated volume of the subterranean formation 22 and the wellbore 18 may be increased due to additional pathways being created by the microholes.

The process 50 may include delivering (block 56) the reactive components to the prepared target area for the reaction to take place. The reactive components may be delivered to the target area by pumping the reactive components to the reaction site via well lines, coiled tubing, drillpipe tubing, encapsulation, or another other suitable method. It may be appreciated that the reactive components may be delivered to the reaction site in separate compartments or in a single compartment.

After the reacting components are delivered via the microholes or jetted slots, the process 50 includes determining (block 58) if the reaction has been completed to the desired extent. The desired extent of the reaction may be determined in part by whether or not a threshold amount of the reactive materials have been pumped through the wellbore 18. If less than the desired amount of the reactive materials have been pumped through the wellbore 18, the process 50 includes continuing to deliver reactive components to the reaction site from the surface. After the desired amount of the reactive materials have been pumped through the wellbore, the process 50 stops (block 60) delivery of reactive components to the reaction site. An example illustration of the microholes connected to the target area is detailed below with reference to FIG. 4.

FIG. 3 describes a process 70 for identifying a target area and enabling connectivity between the subterranean formation 22 and the wellbore 18. The process 70 includes identifying (block 72) a target area for the reactive components (e.g., metals and oxidizers, non-metallic fuels and oxidizers, etc.) to be delivered to the reaction site from the surface. The process 70 may then include preparing a target area for receiving the reactive components. Preparing the target area may include using cement slurries (block 74) to increase control over the timing of the reactions. For example, the cement slurries may be injected with reactive components and allowed to cure so that the reactive components are stored in the cured cement. The cement slurries may be delivered to the reaction site via a well line, tubing, or other suitable manner.

The process 70 may include perforating the cement (block 76) containing solidified reactive components by using perforating. When the cement is contacted by a tool (e.g., a perforating gun), the cement may receive an electrical charge to initiate the chemical reaction at the reactive site so that the hydraulic fractures are further opened to enable the formation fluids to flow into the wellbore 18, as explained in further detail below. The process 70 includes determining (block 78) whether a threshold amount of reactive materials have reacted in the wellbore 18. When the desired amount of reactive materials have not completed reacting in the wellbore 18, the process 70 includes continuing to perforate the cement with the perforating gun. When the desired mount of reactive materials has been reacted in the wellbore 18, the process 70 stops (block 80) delivery of the reactive components to the reaction site. An example illustration of the cement placed in the target area is detailed below with reference to FIG. 5.

Figure 4:
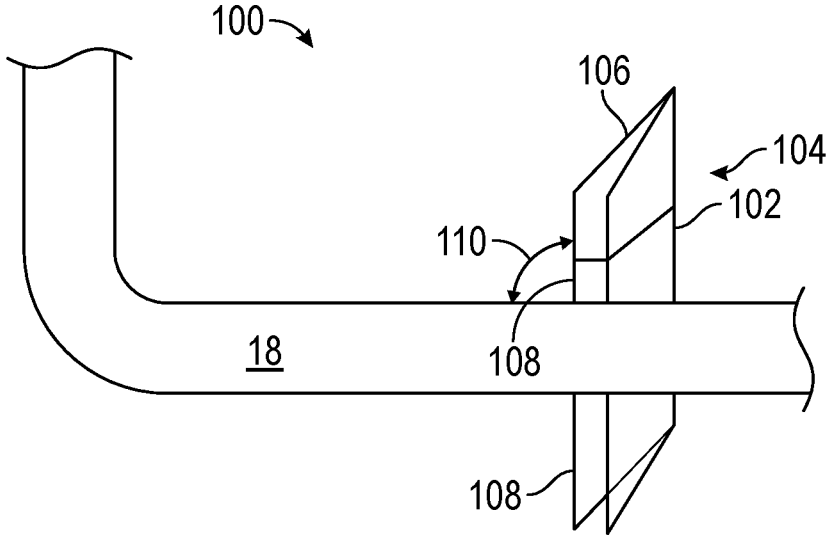
FIG. 4 is a schematic diagram of a portion of a wellbore of the well-fracturing system of FIG. 1 that uses microholes to increase connectivity of the wellbore to a surrounding geological formation, in accordance with an embodiment.

FIG. 4 illustrates a portion of the wellbore 18 and a stimulated volume 100 of the subterranean formation 22 (e.g., a geological formation). The stimulated volume 100 may include an area of the subterranean formation 22 where a majority of formation fluids are found within the subterranean formation 22. Fractures that are generated in the subterranean formation 22 may be concentrated in the stimulated volume 100. As may be appreciated, the presence of isolated geological features 102 (e.g., geological faults) may cause the stimulated volume 100 to be separated (e.g., pinched off) from the wellbore 18 at a location 104. When the stimulated volume 100 is separated from the wellbore 18 at the location 104, a portion 106 of the stimulated volume 100 above the isolated geological feature 102 may no longer be in fluid communication with the wellbore 18 and/or a portion 108 of the stimulated volume 100 below the isolated geological feature. It may appreciated that the presence of the isolated geological feature(s) 102 may be identified by seismic data analysis or other suitable subterranean formation detection devices.

As described above, with reference to FIG. 2, a plurality of microholes 110 or jetted slots may be formed by a suitable method, such as drilling between the wellbore 18 and the stimulated volume 100. The plurality of microholes 110 may create an alternate pathway to connect the portion 106 of the stimulated volume 100 above the isolated geological feature 102 to the wellbore 18. In other words, the plurality of microholes 110 increases the connectivity between the portion 106 of the stimulated volume 100 above the isolated geological feature 102 with the wellbore 18 by creating additional pathways (e.g., additional fractures) from the wellbore 18 to stimulated volume 100. It may be appreciated that the microholes 110 may be created in a number of suitable ways, such as by drilling, using chemicals (such as acids) to etch out microholes in the formation. The microholes 110 may vary in size (e.g., length, diameter) and placement. In some embodiments, it may be beneficial to concentrate the placement of microholes 110 in an area of the stimulated volume 100 where formation fluids are more readily accessible (e.g., more readily extracted).

Figure 5:
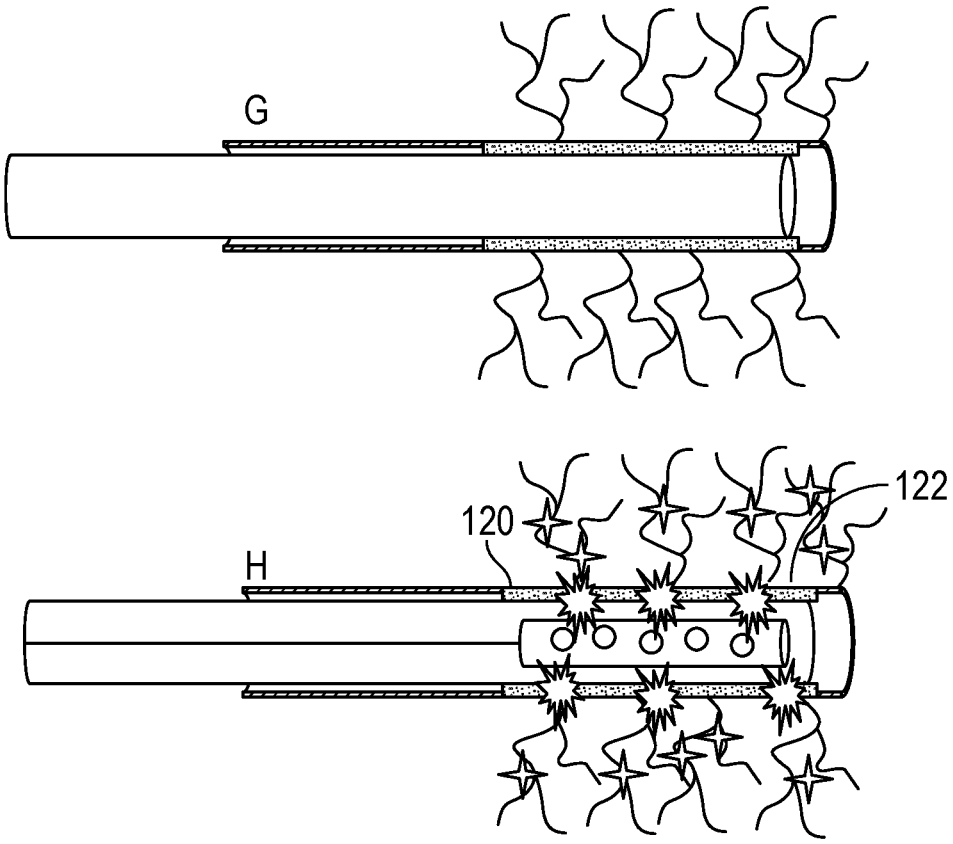
FIG. 5 is a schematic diagram of a cement block (e.g., a thermite-rich cement) for placing in the wellbore of the well-fracturing system of FIG. 1, in accordance with an embodiment.

FIG. 5 illustrates a thermite-rich cement region 120 that may be disposed within the wellbore. As described above, with reference to FIG. 3, the cement region 120 may contained reactive components that are later perforated to initiate the chemical reaction of the reactive components. That is, before the cement slurries are deposited in the wellbore 18 as a casing for the wellbore 18, the cement slurries may be mixed with the reactive components. For example, the cement slurries may be injected with reactive components and cured so that the reactive components are solidified within the cement region 120. In certain embodiment, the cement region may be concentrated in a section of the wellbore 18 or distributed throughout the wellbore 18. It may be appreciated that the cement blocks 120 may be isolated from the rest of the wellbore 18 by using a packer or other suitable equipment. The cement region 120 may then be perforated by using a perforating gun or other suitable device. In some embodiments, the perforating gun may deliver an electrical charge through the cement region 120 to initiate the thermite reaction and further generate perforations 122. Alternatively, the thermite reaction may be initiated by any of the methods (e.g., radiation-induced ignition, mechanical ignition, electrical ignition, chemical reaction, etc.) described below with reference to FIGS. 6-15.

Stimulation of Reservoir Stimulation Via Thermite Ignition

FIGS. 6-15 describe various methods for initiating thermite reactions downhole, which result in stimulation of the reservoir. The methods described herein may broadly include chemical reactions, electricity, electromagnetic radiation, and/or chemical processes. As described above, thermite reactions refer to a broad class of exothermic reduction-oxidation reactions of metals with metal oxides of less reactive metals. When ignited, the reactive components (e.g., thermites) may release a large amount of heat that may be used to volumetrically expand the fracturing fluid, thereby opening the fractures in the geological formation for receiving proppants and/or increasing hydrocarbon production.

Figure 6:
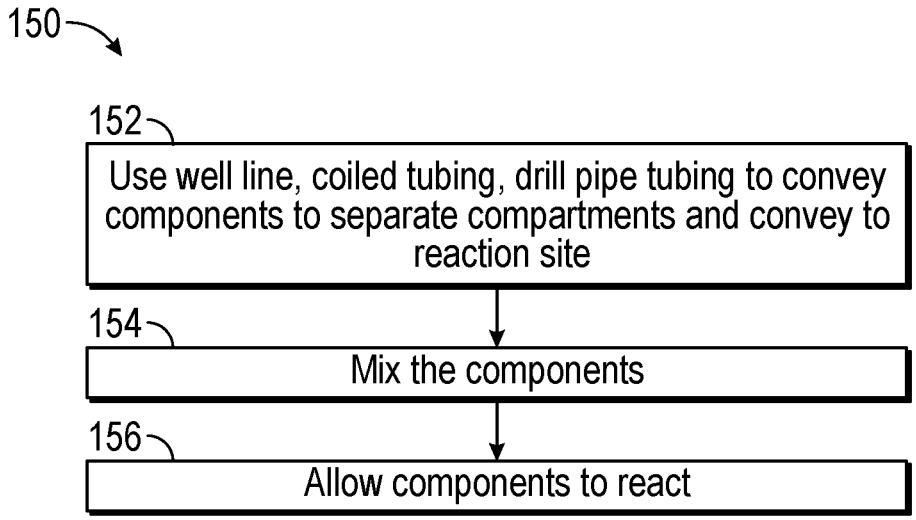
FIG. 6 is a flowchart illustrating a process for initiating thermite reactions in a downhole tool of the well fracturing system of FIG. 1, in accordance with an embodiment.
Figure 7:
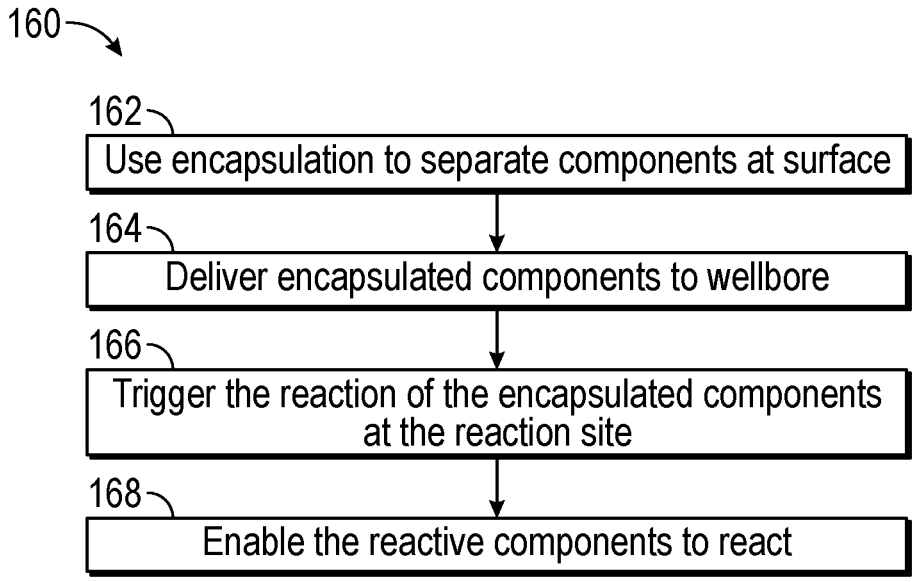
FIG. 7 is a flowchart illustrating a process for initiating thermite reactions in the downhole tool of the well fracturing system of FIG. 1 via triggering the thermite reaction, in accordance with an embodiment.
Figure 8:
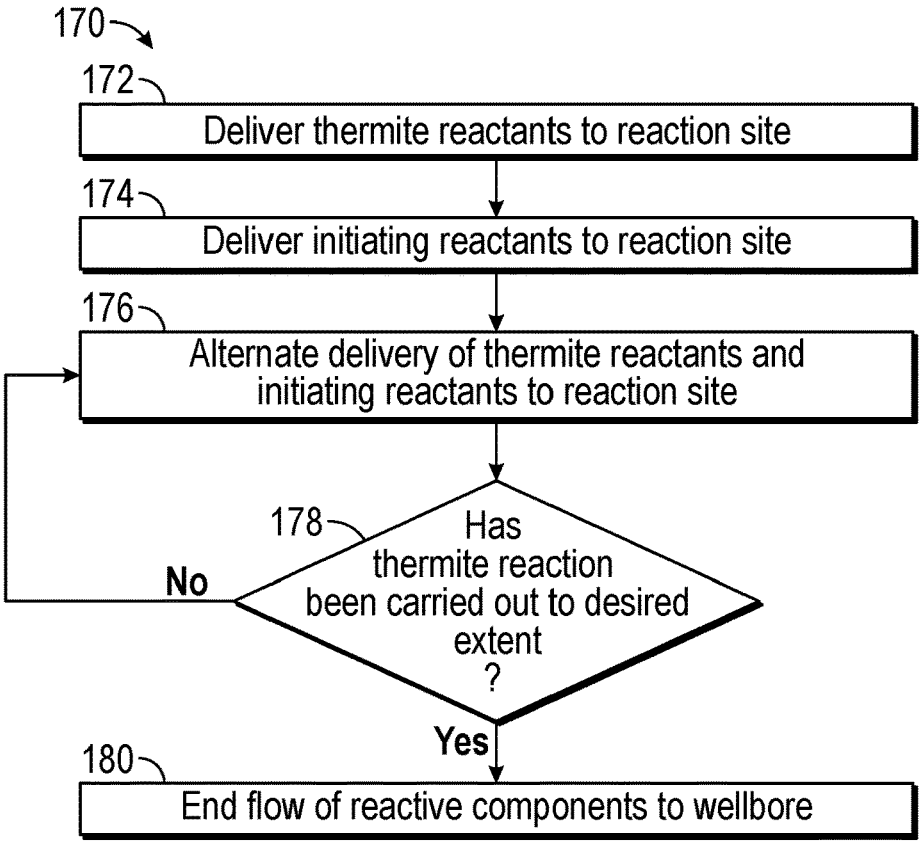
FIG. 8 is a flowchart illustrating a method for initiating thermite reactions in the downhole tool of the well fracturing system of FIG. 1 via alternating the reactive components, in accordance with an embodiment.

FIGS. 6-8 describe various methods for initiating chemical reactions. As described in detail below, a thermite mixture (e.g., a thermite slurry including a carrier fluid, a proppant, and reactive materials such as metals and metal oxides to carry out the thermite reaction) may be used to create a hydraulic fracture in the surrounding formation. The chemical (e.g., thermite) mixture may be ignited by the heat produced by a different chemical reaction that is easier to initiate than the thermite reaction itself or by a series of different chemical reactions that are progressively easier to initiate. For example, the chemical reactions may include reactions between metals (e.g., lithium, sodium, magnesium (e.g. "magnesium flares"), aluminum, iron, copper, etc.) and oxidizers (e.g., persulfates, perchlorates, bromates, permanganates, peroxides, etc.). The chemical reactions may also include reactions between non-metallic fuels (e.g. explosives, hydrocarbons, etc.) and oxidizers (e.g., persulfates, perchlorates, bromates, permanganates, peroxides, etc.). In other examples, a reaction between water-sensitive metals and metal alloys with water may be used to initiate the thermite reaction. For example, lithium, sodium, magnesium, aluminum, or other metals may be reacted with water to generate a highly exothermic reaction, thereby providing heat to initiate the thermite reaction.

FIG. 6 is a flowchart illustrating one process 150 for initiating thermite reactions in the downhole tool of FIG. 1. The process 150 includes separating (block 152) the components of the chemical reaction downhole via coiled tubing, a well line, or drillpipe tubing to create separate compartments for the components (e.g., a metals compartment, an oxidizer compartment) as the reactive components are delivered to the reaction site. For example, the control system 36 may send a signal to a valve to open and enable the compartments to open and be filled with the reactive components. The control system 36 may also control the amount of reactive materials that are introduced to the compartments, the composition of the reactive components and overall composition of the fracturing fluid that is injected into the wellbore 18, and/or the flow rate at which the reactive components and/or the fracturing fluid is pumped. The reactive components may remain separated until the components reach the desired reaction site, or the reactive components may be allowed to mix prior to the desired reaction site.

The process 150 includes mixing (block 154) the components at the desired reaction site. Here, the control system 36 may send signals to valves associated with the compartments to open to enable to the reactive components to be released from the compartments and mixed. The control system 36 may control the flow rate at which the reactive components are allowed to mix, how long the reactive components are released, whether or not the reactive components are continuously released compared to pulsed, and so forth. In some embodiments, the process 150 utilizes a mixer or other mechanical equipment to facilitate mixing of the reactive components. The control system 36 may send a signal to the mixer to control the operation of the mixer and/or other mechanical equipment, as described with reference to FIG. 13.

The process 150 includes enabling the reactive components to react (block 156). It may be appreciated that the reactive components may react in a series of reactions. For example, a chemical reaction may first occur between the reactive components (e.g., water sensitive metals and metal alloys). The heat of the first chemical reaction may provide energy (e.g., heat) to initiate a second reaction to occur (e.g., a thermite reaction). The thermite reaction may be highly exothermic and cause the fracturing fluid to expand in the wellbore, thereby opening the hydraulic fractures. The control system 36 may control the rate of the chemical reaction by controlling the flow rate at which the reactive components are released from the compartments. The control system 36 may then receive an indication (e.g., a signal) that a desired process condition (e.g., use of a desired amount of reactive materials, a time condition, etc.) is met. The control system 36 may then reduce or stop the flow of the fracturing fluid to the wellbore 16. It may be appreciated the process described herein may be repeated, used continuously, or used intermittently as the availability of the surface equipment (e.g., pumps) changes.

FIG. 7 is a flowchart illustrating a process 160 for initiating thermite reactions in the downhole tool of FIG. 1. The process 160 includes using encapsulation (block 162) to separate the components of the chemical reaction. The components may be encapsulated by coating the reactive components with a thin film or coating that can be dissolved or otherwise removed to release the reactive components. Encapsulating the components may increase the useful life span of the reactive components by protecting the reactive components from environmental effects, such as contact with other components or downhole fluids that may reduce the effectiveness of the reactive component.

The process 160 includes delivering (block 164) the components of the chemical reaction downhole. The control system 36 may send a signal to a valve to open and enable the encapsulated components to be released. For example, the reactive components may be held in encapsulated coatings and may be released when signaled by the control system 36. The control system 36 may also be used to control the amount of encapsulated reactive materials that are introduced to the wellbore 18, the composition of the reactive components and overall composition of the fracturing fluid that is injected into the wellbore 18, and/or the flow rate at which the encapsulated reactive components and/or the fracturing fluid is pumped.

The process 160 includes triggering (block 166) the reaction at the desired reaction site. The triggering of the thermite reaction may be accomplished by a time-release of the reactive components, reaching a trigger temperature, crushing the encapsulated components, or other suitable triggers to trigger the reaction. The control system 36 may control the rate at which the encapsulated reactive materials are able to be mix by controlling a trigger. For example, the control system 36 may control the time at which the reactive materials are able to contact each other by controlling the release of the reactive materials. Still further, the control system 36 may control equipment associated with a crushing mechanism (e.g., a rotating blade, a grinder). For example, the control system 36 may signal the equipment to begin operating when it is desired to remove the coating on the encapsulated reactive materials. In another example, the control system 36 may control temperature of the fracturing fluid to control the temperature of the fracturing fluid and/or the reactive components so that the encapsulated components are released at a desired temperature condition.

The process 160 includes enabling the reaction (block 168) of the components to carry about the desired reaction (e.g., the chemical reaction) so that the heat produced by the chemical reaction can initiate the thermite reaction (e.g., by ignition of a thermite slurry). The control system 36 may control the rate of the chemical reaction by controlling the flow rate at which the reactive components are released from the compartments. The control system 36 may then receive an indication (e.g., a signal) that a desired process condition (e.g., use of a desired amount of reactive materials, a time condition, etc.) is met. The control system 36 may then reduce or stop the flow of the fracturing fluid to the wellbore 16. It may be appreciated the process described herein may be repeated, used continuously, or used intermittently as the availability of the surface equipment (e.g., pumps) changes.

FIG. 8 is a flowchart illustrating one process 170 for initiating thermite reactions in the downhole tool of FIG. 1. The process 170 includes delivering thermite reactants (block 172) to the desired reaction site. For example, the control system 36 may send a signal to a valve to open and release thermite reactants into the wellbore 18. The control system 36 may also be used to control the amount of thermite reactants that are introduced to the wellbore 18 (e.g., into various compartments), the composition of the reactive components and overall composition of the fracturing fluid that is injected into the wellbore 18, and/or the flow rate at which the thermite reactants and/or the fracturing fluid is pumped.

The process 170 includes delivering (block 174) the initiating reactants to the desired reaction site. The control system 36 may send a signal to a valve to open and release initiating reactants into the wellbore 18. The control system 36 may also be used to control the amount of the initiating reactants that are introduced to the wellbore 18 (e.g., into various compartments), the composition of the initiating reactants and overall composition of the fracturing fluid that is injected into the wellbore 18, and/or the flow rate at which the initiating reactants and/or the fracturing fluid is pumped.

The process 170 may include alternating (block 176) of the thermite reactants and the initiating reactants to the desired reaction site. The amount of the thermite reactants and/or the initiating reactants may vary depending on when the reactants are introduced to the wellbore 18. The control system 36 may control the order of which the reactive materials are introduced to the wellbore 18. For example, the control system 36 may control the order of the delivery of the reactive components, the amount of time each of the components is pumped to the wellbore 18, and so forth.

The process 170 includes determining (block 178) if the reaction has been completed to the desired extent. In one example, the desired extent of the reaction may be determined in part by whether or not a desired amount of reactive components have been introduced to the wellbore 18 to enable the chemical reactions to occur. If the amount of reactive components remains below the desired amount of the reactive components introduce to the wellbore 18, the process 170 includes continuing to alternate the delivery of the thermite reactants and the initiating reactants to the desired reaction site. If the amount of reactive components introduced to the wellbore 18 is met, the process 170 stops or reduces the flow of reactive components (block 180) to the wellbore 18.

Figure 9:
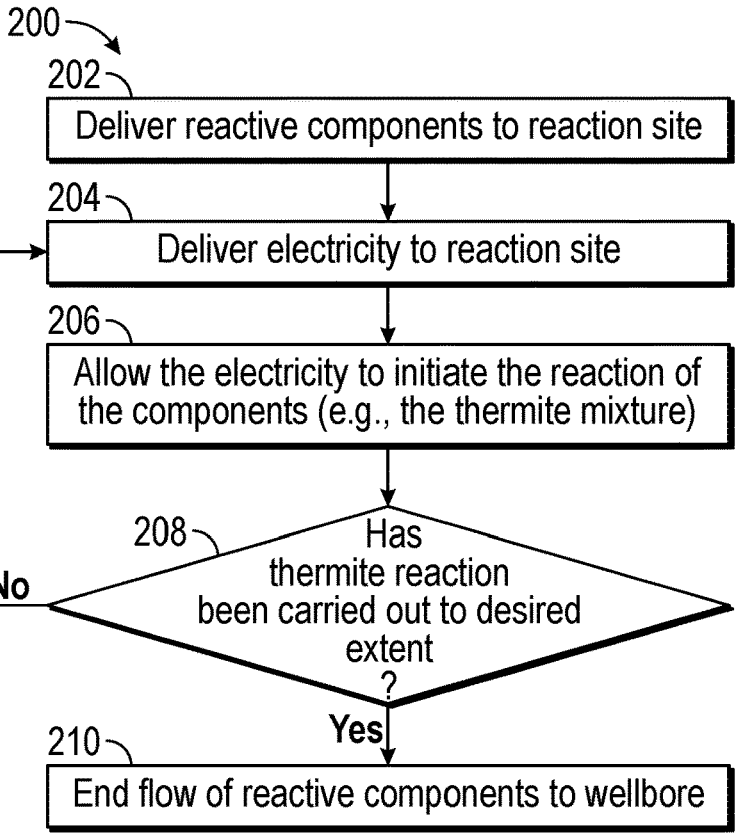
FIG. 9 is a flowchart illustrating a method for initiating thermite reactions in the downhole tool of the well fracturing system of FIG. 1 using electricity, in accordance with an embodiment.

FIG. 9 is a flowchart illustrating one process 200 for initiating thermite reactions in the downhole tool of FIG. 1. The process 200 includes delivering (block 202) reactive components (e.g., the thermite mixture) to the reaction site. As described above, the control system 36 may send a signal to a valve to open and release the reactive components into the wellbore 18. The control system 36 may also be used to control the amount of the reactive components that are introduced to the wellbore 18 and/or the flow rate at which the reactive components and/or the fracturing fluid is pumped.

The process 200 includes delivering (block 204) electricity to the reactive components via a slickline/wireline, a wired drill pipe/casing, wire coiled tubing, and/or umbilical cables. The control system 36 may control the rate at which the electricity is delivered and/or the current or voltage of the electricity supplied to the wellbore 16. The process 200 includes allowing (block 206) the electricity to initiate the reaction of the components. The control system 36 may control the timing and/or manner at which the electricity is released onto the reactive components. For example, the electricity may be released continuously or pulsed or otherwise controlled.

The process 200 includes determining (block 208) if the reaction has been completed to the desired extent. In one example, the desired extent of the reaction may be determined in part by whether or not the desired amount of the reactive components have been delivered to the wellbore. If the amount of reactive components remains below the threshold, the process 200 includes continuing to deliver electricity to the reaction site. When the amount of reactive components delivered to the wellbore 18 is met, the process 200 stops (block 210) delivery of electricity to the reaction site.

Figure 10:
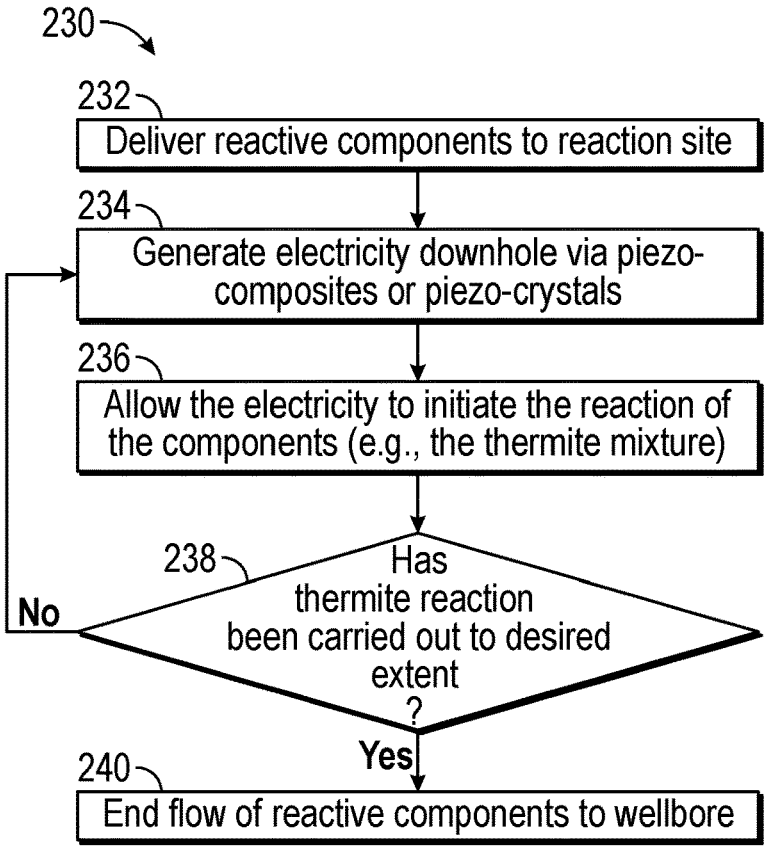
FIG. 10 is a flowchart illustrating a method for initiating thermite reactions in the downhole tool of the well fracturing system of FIG. 1 via piezo-composite fibers, in accordance with an embodiment.

FIG. 10 is a flowchart illustrating one process 230 for initiating thermite reactions in the downhole tool of FIG. 1. The process 230 includes delivering (block 232) reactive components (e.g., the thermite mixture) to the reaction site. The control system 36 may send a signal to a valve to open and release the reactive components into the wellbore 18. The control system 36 may also control the timing and release of the reactive components into the wellbore 18, as described above.

The process 230 includes generating (block 234) electricity at the reactive site for delivery to the reactive components via piezo-composites or piezo-crystals. For example, the piezo-composites or piezo-crystals may be introduced to the wellbore 16 via flexible piezoelectric fibers, which may used to convert mechanical energy to electrical energy. The control system 36 may control the pressure applied to the flexible piezoelectric fibers via a mechanical device and/or a flow rate of the surrounding fluid, thereby controlling the amount electricity generated.

The process 230 includes allowing (block 236) the electricity to initiate the reaction of the components (e.g., the thermite mixture). The control system 36 may control the timing and/or manner in which the electricity is released onto the reactive components. For example, the electricity may be released continuously or pulsed or otherwise controlled.

The process 230 includes determining (block 238) if the reaction has been completed to the desired extent. In one example, the desired extent of the reaction may be determined in part by whether or not the desired amount of the reactive components have been delivered to the wellbore. If the amount of reactive components remains below the threshold, the process 230 includes continuing to deliver electricity to the reaction site. When the amount of reactive components delivered to the wellbore 18 is met, the process 230 stops (block 240) delivery of electricity to the reaction site.

Figure 11:
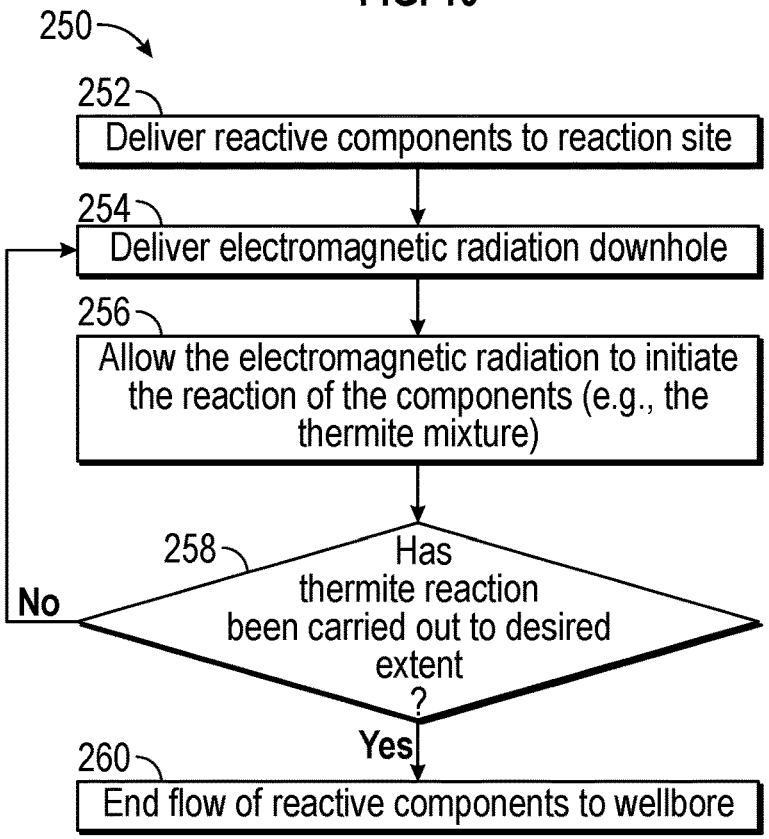
FIG. 11 is a flowchart illustrating a method for initiating thermite reactions in the downhole tool of the well fracturing system of FIG. 1 via electromagnetic radiation, in accordance with an embodiment.

FIG. 11 is a flowchart illustrating one process 250 for initiating thermite reactions in the downhole tool of FIG. 1. The process 250 includes delivering (block 252) reactive components (e.g., the thermite mixture) to the reaction site. The control system 36 may send a signal to a valve to open and release the reactive components into the wellbore 18. As described above, the control system 36 may also control the timing and release of the reactive components into the wellbore 18.

The process 250 includes delivering (block 254) electromagnetic radiation to the reactive components via fiber optic cables. The electromagnetic radiation may be in the form of laser, infrared, microwaves, or other forms of electromagnetic radiation. The control system 36 may control the amount of electromagnetic radiation supplied to the wellbore, the duration and/or the frequency at which the electromagnetic radiation is supplied to the wellbore, and/or the area which the electromagnetic radiation is supplied.

The process 250 includes allowing (block 256) the electromagnetic radiation to initiate the reaction of the components (e.g., the thermite mixture). The control system 36 may control the timing and/or manner in which the electromagnetic radiation is released into the reactive components. The electromagnetic radiation may be released continuously, for a given duration, or pulsed.

Figure 12:
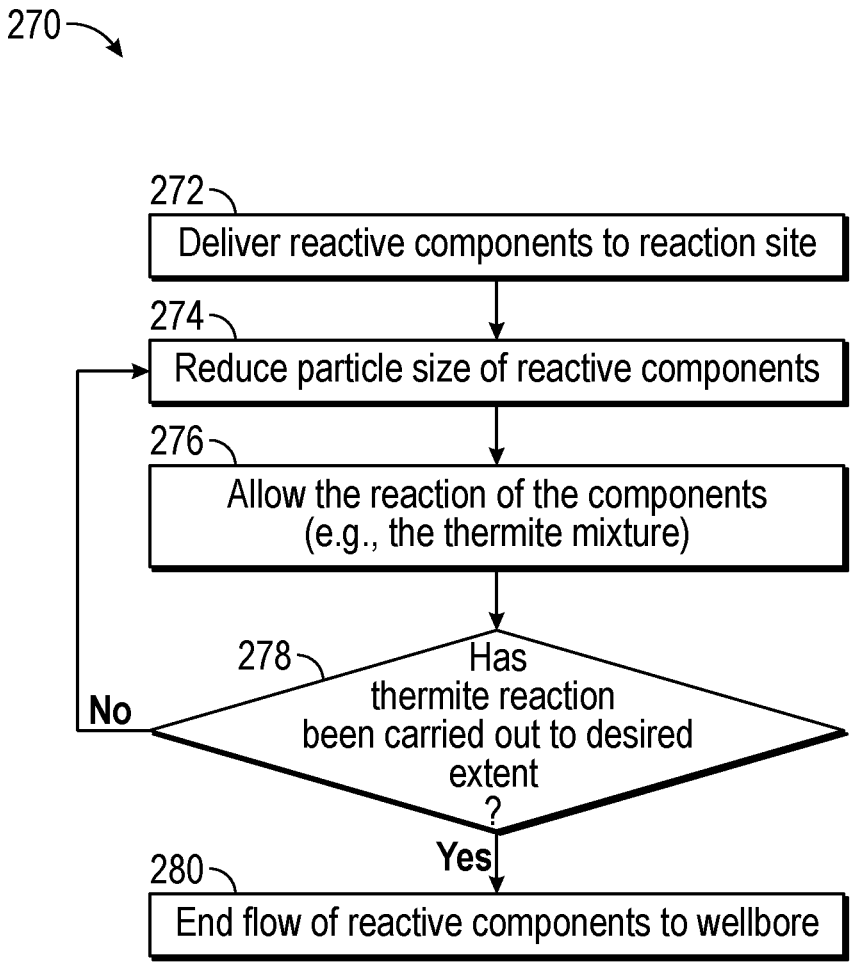
FIG. 12 is a flowchart illustrating a method for initiating thermite reactions in the downhole tool of the well fracturing system of FIG. 1 based on sizes of the reactive components, in accordance with an embodiment.
Figure 13:
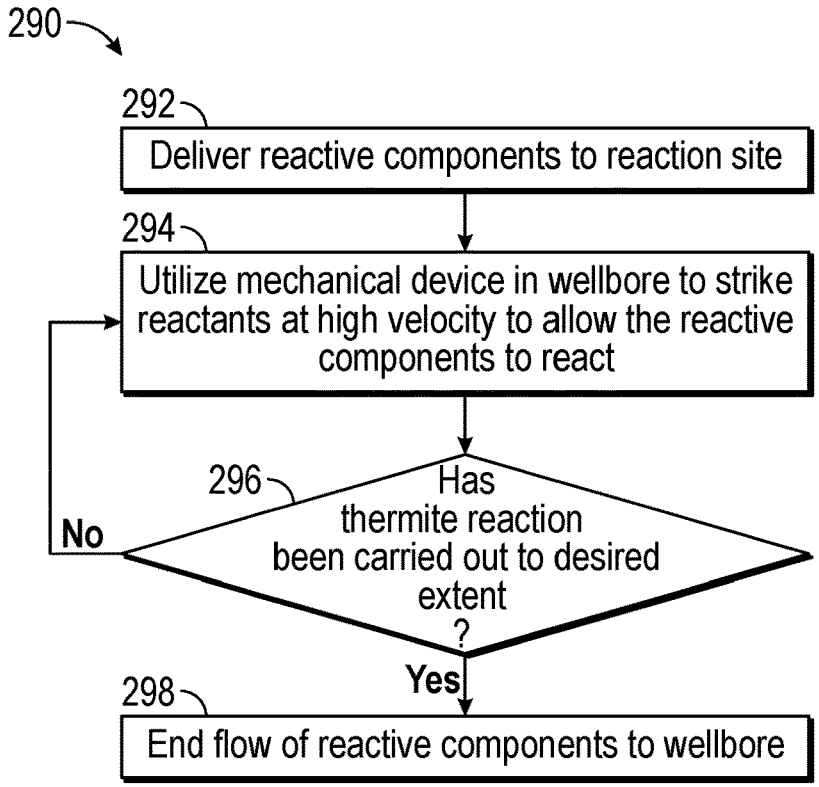
FIG. 13 is a flowchart illustrating a method for initiating thermite reactions in the downhole tool of the well fracturing system of FIG. 1 using a mechanical device, in accordance with an embodiment.
Figure 14:
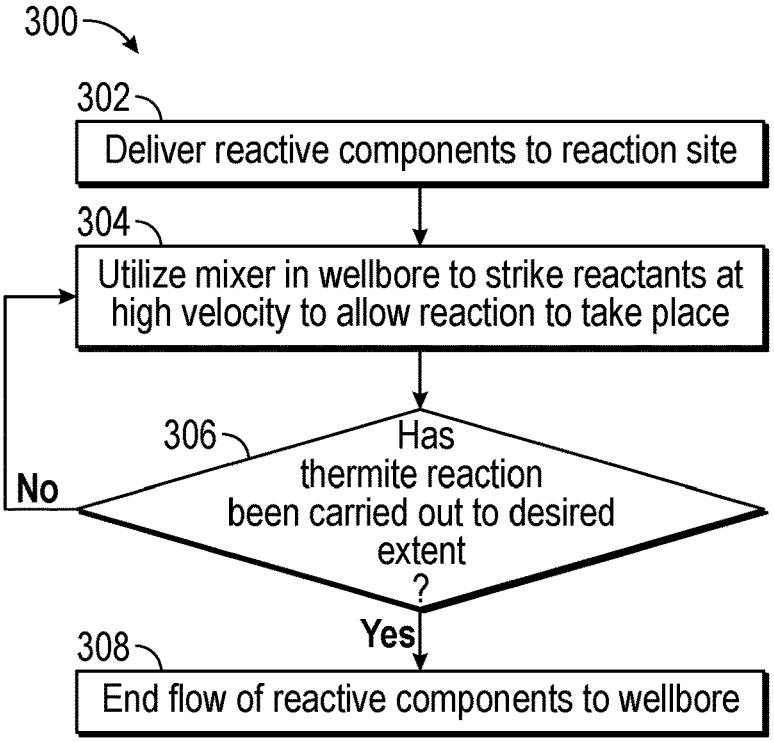
FIG. 14 is a flowchart illustrating a method for initiating thermite reactions in the downhole tool of the well fracturing system of FIG. 1 using a mixer, in accordance with an embodiment.

The process 250 includes determining (block 258) if the reaction has been completed to the desired extent. The desired extent of the reaction may be determined in part by whether or not the desired amount of the reactive components have been delivered to the wellbore 18. If the amount of reactive components remains below the threshold, the process 250 includes continuing to deliver electromagnetic radiation to the reaction site. When the amount of reactive components delivered to the wellbore 18 is met, the process 250 stops (block 260) delivery of electromagnetic radiation to the reaction site. FIGS. 12-14 describe various methods for initiating chemical reactions via mechanical tools. FIG. 12 is a flowchart illustrating one process 270 for initiating thermite reactions in the downhole tool of FIG. 1.

The process 270 includes delivering (block 272) reactive components (e.g., the thermite mixture) to the reaction site from the surface. The control system 36 may send a signal to a valve to open and release the reactive components into the wellbore 18. The control system 36 may also control the timing and release of the reactive components into the wellbore 18, as described above. The process 270 includes reducing (block 274) the size of the particles of the reactive components by using a mechanical tool, such as a reamer, grinder, or crusher. The control system 36 may be used to control the operating of the mechanical tool, the amount of time the mechanical tool is operated, when the tool is operated, and/or the size the reactive components are reduced to.

The process 270 includes allowing (block 276) the reactive components to react. The control system 36 may control the rate at which the reactive components are resized, thereby controlling the reaction rate of the reactive components in part based on the particle size. The smaller size of the particles may increase reactivity of the particles because the smaller size particles may increase the overall surface area of the particles. In other words, the overall increase in surface area may enable the reactive components to come into contact with each other more readily. The increase in contact of the reactive components may release more heat as the thermite reaction progresses, thereby increasing the volumetric expansion of the fracturing fluid (e.g., the fluid containing the reactive components, the slurry mixture, and the proppant).

The process 270 includes determining (block 278) if the reaction has been completed to the desired extent. The desired extent of the reaction may be determined in part by whether or not the desired amount of reactive components have been delivered to the wellbore 18. If the amount of reactive components remains below the threshold, the process 270 includes continuing to reduce the particle size of the reactive components. When the desired amount of reactive components delivered to the wellbore 18 is met, the process 270 stops (block 280) delivery of the reactive components to the reaction site.

FIG. 13 is a flowchart illustrating one process 290 for initiating thermite reactions in the downhole tool of FIG. 1. The process 290 includes delivering (block 292) reactive components (e.g., the thermite mixture) to the reaction site from the surface. The control system 36 may send a signal to a valve to open and release the reactive components into the wellbore 18. The control system 36 may also control the timing and release of the reactive components into the wellbore 18, as described above.

The process 290 includes using (block 294) a mechanical device (e.g., rotating blade, reamer, crusher, grinder, etc.) disposed within the downhole tool to strike the reactive components at high velocity. By striking the reactive components at high velocity, the reactive components may increase impact with one another to improve the chemical reactivity of the components. In other words, the increase impact of the reactive components with one another may increase the amount of time the components are in contact with each other. As such, the reaction may release more heat, thereby increasing the volumetric expansion of the fracturing fluid (e.g., the fluid containing the reactive components, the slurry mixture, and the proppant). The control system 36 may control the operation of the mechanical device (e.g., how fast the mechanical device strikes the reactive components), the amount of time the mechanical device is operated, and/or when the mechanical tool is utilized.

The process 290 includes determining (block 296) if the reaction has been completed to the desired extent. The desired extent of the reaction may be determined in part by whether or not the desired amount of reactive components have been delivered to the wellbore 18. If the amount of reactive components remains below the threshold, the process 270 includes continuing to reduce the particle size of the reactive components. When the desired amount of reactive components delivered to the wellbore 18 is met, the process 290 stops (block 298) delivery of the reactive components to the reaction site.

FIG. 14 is a flowchart illustrating one process 300 for initiating thermite reactions in the downhole tool of FIG. 1. The process 300 includes delivering (block 302) reactive components (e.g., the thermite mixture) to the reaction site from the surface. The control system 36 may send a signal to a valve to open and release the reactive components into the wellbore 18. The control system 36 may also control the timing and release of the reactive components into the wellbore 18, as described above.

The process 300 includes using (block 304) a mixer or other suitable equipment disposed within the downhole tool to generate localized energy to initiate the chemical reaction. The control system 36 may control the operation of the mixer, the amount of time the mixer is operated, and/or when the mixer is utilized.

The process 300 includes determining (block 306) if the reaction has been completed to the desired extent. The desired extent of the reaction may be determined in part by whether or not the desired amount of reactive components have been delivered to the wellbore 18. If the amount of reactive components remains below the threshold, the process 300 includes continuing to strike the reactive components. When the desired amount of reactive components delivered to the wellbore 18 is met, the process 300 stops (block 308) delivery of the reactive components to the reaction site.

Use of Disperants to Increase Viscosity of the Slurry Mixture

In addition to the different methods for delivering reactants to the wellbore, it may be useful to improve the flow of the slurry by introducing one or more dispersants to the slurry may decrease the viscosity of the slurry. This will improve the pumpability of the slurry and make it easier to be delivered into the wellbore. By employing dispersants, the reactants may be dispersed more evenly throughout the slurry. As such, the reactants may be ignited throughout the volume of the slurry and may contribute to a greater volumetric expansion of the slurry to further open the surrounding fractures.

After the thermite reactions are ignited, the thermite reactions may generally sustain itself. In other words, after the thermite reaction is ignited, the thermite reaction may produce enough heat to continue to react until the reactants are substantially exhausted (e.g., the reaction is substantially complete). The ignition and propagation of the thermite reaction a carrier fluid may be complicated by a heat loss of the reactants to the carrier fluid. As such, when the heat lost by thermite reactants to the carrier fluid exceeds a threshold, the thermite reaction may not continue to propagate.

The heat lost by the thermite reactants to the surrounding carrier fluid may be balanced against the volume of carrier fluid that is utilized to ensure that the slurry mixture remains pumpable. In other words, it may be desirable to create the slurry mixture such that the lowest possible fluid volume fraction is utilized while the slurry mixture is still pumpable. As described above, one such method to increase the pumpability of the slurry mixture is to add one or more dispersants to the slurry mixture. The dispersants may be added to the slurry mixture in any suitable manner, including but not limited to: preparing the dispersant-slurry mixture in a batch mixing tank followed by injecting the dispersant-slurry mixture into the wellbore, pumping a carrier-fluid and dispersant solution to the wellbore and later adding the thermite reactants to the carrier-fluid and dispersant solution on the fly in a relatively continuous manner, and/or pumping a carrier-fluid to the wellbore and later adding the thermite reactants and the dispersants to the carrier-fluid on the fly in a relatively continuous manner.

In certain embodiments, the dispersants may be polymers (e.g., polyacrylic acid), polyacrylates (e.g., ammonium, sodium, potassium polyacrylates), polymethacrylic acid, polymethacrylates (e.g., ammonium, sodium, potassium polymethacrylates), polycarboxylates, polyvinylpyrolidones, polystyrene sulfonate, polynaphthalene sulfonates, lignosulfonates, other sulfonates, polyacrylamides, poly(2-acrylamido-2-methyl-1-propanesulfonic acid) (e.g., polyAMPS), as well as derivatives, copolymers, and any mixtures of the above polymers.

Other examples of dispersants may be small molecule surfactants, such as sulfonates, phosphates, carboxylates (e.g. acrylates, methacrylates, etc.), dodecylbenzene sodium sulfonate, trisodium phosphate, aurintricarboxylic acid ammonium salt, 4-5-dihydroxy-1, 3-benzenedisulfonic acid disodium salt, and sodium hexametaphosphate, as well as derivatives and mixtures of the above surfactants.

The benefits of adding the dispersants to the slurry mixture may be further understood with reference to the following examples. In one non-limiting example, 5 grams (g) of a thermite mixture was prepared by mixing 1.25 g of aluminum and 3.75 g of iron (III) oxide. Approximately 1.06 g of deionized water and 0.14 g of a 25% aqueous solution of ammonium polymethacrylate were added to the thermite mixture and mixed. When the dispersant (e.g., ammonium polymethacrylate) was added to the thermite mixture, the resulting thermite mixture became pumpable. In this example, the volume fraction of the thermite in the mixture was approximately 0.50. However, without the addition of the dispersant, a mixture composed of 0.50 volume fraction thermite was a crumbly powder, i.e. it was not pumpable. In other words, without the addition of the dispersant to the thermite mixture, the thermite mixture was not pumpable.

In another non-limiting example, 5 g of a thermite mixture was prepared by mixing 1.25 grams (g) of aluminum) and 3.75 g of iron (III) oxide. Approximately 1.13 g of deionized water and 0.07 g of a 43% aqueous solution of sodium polyacrylate) was added to the thermite mixture, the resulting thermite mixture was able to be pumped (i.e., pumpable). In this example, the volume fraction of the thermites in this solution was approximately 0.50. As in the example above, without the addition of the dispersant to the solution, the thermite mixture may be a crumbly powder. In other words, without the addition of the dispersant to the thermite mixture, the thermite mixture was not pumpable.

It may be appreciated that the amount of dispersants added to the slurry mixture may range from approximately 0.1 to 10% weight percent of the dispersant, 1 to 5% weight percent, or any weight percentage there between.

Saturated Salt Solutions as Carrier Fluids

As may be appreciated, utilizing certain fluids (e.g., water) as the carrier fluid may reduce the heat generated by the exothermic thermite reactions. Reducing the heat generated by the exothermic thermite reactions may inhibit the propagation of the thermite reactions, thereby reducing the desired effect of the volumetric expansion of the thermite slurry as the thermites react. By utilizing certain salt solutions, such as zinc-halide or zinc-complexed solutions (e.g., saturated zinc bromide solutions, saturated zinc chloride solutions), the thermite carrier fluids may enable the heat released by the exothermic thermite reaction to remain in the slurry mixture longer, which may contribute to continued propagation of the thermite reaction.

When certain saturated salt solutions are used as the thermite carrier fluids, the thermite reaction propagates throughout the slurry mixture (e.g., the thermite/fluid mixture) when the thermites are present at volume fractions as low as 0.3. In other words, the slurry mixture may include compositions that are substantially liquid-based thermites slurry mixtures. As may be appreciated, the liquid-based thermite slurry mixture may be easily delivered into the wellbore and the surrounding geological formation when compared to slurry mixtures with higher concentrations of thermite.

The benefits of utilizing salt solutions as carrier fluids may be further understood with reference to the following examples. In one non-limiting example, 5 grams (g) of a thermite mixture was prepared by mixing 1.25 g of aluminum and 3.75 g of iron (III) oxide. Subsequently, various amounts of a zinc-halide or zinc-complexed solutions, such as an 80% by weight zinc bromide (ZnBr2) solution in deionized water, were added to the thermite mixture. For each thermite and zinc bromide-water mixture (e.g., thermite-ZnBr2 solution mixture), a series of ignition experiments were performed. The results of the ignition experiments may be further understood with reference to Table 1.

burned in each iteration of the ignition experiment as shown in the right most column of Table 1.

The ignition experiments demonstrated that the ignitability of the thermite/ZnBr2 solution mixture is dependent on the volume fraction of thermite (e.g., the solid volume fraction) in the thermite/ZnBr2 solution mixture.

The ignition experiments demonstrated that when the thermite/ZnBr2 solution included a solid volume fraction greater than 0.3, complete combustion of the mixture was observed, as demonstrated by Rows 3-5 of Table 1. In comparison, when the thermite/ZnBr2 solution included a solid volume fraction less than 0.3, only the starter mixture burned, as demonstrated by Row 1 of Table 1.

The physical appearance of the thermite-ZnBr2 solution mixture confirmed that certain volume fractions of thermites in the thermite-ZnBr2 solution mixture result in mixtures that may be pumpable. That is, complete combustion of the thermite-ZnBr2 solution mixture was achieved when the solid volume fraction of thermite in the thermite-ZnBr2 solution mixture exceeded approximately 0.3. In contrast, when no salt solution was used, mixtures of thermite and water required a thermite volume fraction of 0.5 or more to achieve complete combustion. Moreover, these mixtures were crumbly powders, i.e., not pumpable.

TABLE 1

Physical Appearance and Ignition Observations of Thermite and 80 wt. % $ZnBr_2$ Solution Mixture

| Row | Mass of aluminum (g) | Mass of iron (III) oxide (g) | Volume of 80 wt. % $ZnBr_2$ solution (mL) | Volume fraction of thermite | Physical Appearance of Thermite/Water Mixture (Thermite-$ZnBr_2$ solution mixture) | Ignition Experiment Observations |
|---|---|---|---|---|---|---|
| 1 | 1.25 | 3.75 | 3.2 | 0.27 | Pourable fluid | Only starter mixture burned |
| 2 | 1.25 | 3.75 | 3 | 0.28 | Pourable fluid | Complete combustion of thermite/80% $ZnBr_2$ mixture |
| 3 | 1.25 | 3.75 | 2.5 | 0.32 | Thin paste, pumpable | Complete combustion of thermite/80% $ZnBr_2$ mixture |
| 4 | 1.25 | 3.75 | 2.0 | 0.37 | Thin paste, pumpable | Complete combustion of thermite/80% $ZnBr_2$ mixture |
| 5 | 1.25 | 3.75 | 1.5 | 0.44 | Sticky powder | Complete combustion of thermite/80% $ZnBr_2$ mixture |

The 5 g thermite-ZnBr2 solution mixture was combined with 0.2 g of an 85% by weight iron and potassium perchlorate mixture (e.g., 85% iron and 15% potassium percholorate). Approximately 1 g of a dry-thermite mixture was added to the 5 g thermite-ZnBr2 solution mixture and the 0.2 g of an 85% by weight iron and potassium perchlorate mixture to form a solid thermite mixture, which may be referred to as the starter mixture. In the experiment, the starter mixture was introduced to the thermite/ZnBr2 solution mixture.

A nichrome wire (e.g., NiCr, nickel-chrome, chrome-nickel, etc.) was placed in contact with the starter mixture to stimulate ignition of the starter mixture. Using the nichrome wire, an electric current was applied to the starter mixture. As may be appreciated, the starter mixture ignited and In another non-limiting example, 5 grams (g) of a thermite mixture was prepared by mixing 1.25 g of aluminum and 3.75 g of iron (III) oxide. Subsequently, various amounts of an 80% by weight zinc chloride (ZnCl2) solution in deionized water were added to the thermite mixture. For each thermite and zinc chloride-water mixture (e.g., thermite-ZnCl2 solution mixture), an ignition experiment was performed. The results of the ignition experiments may be further understood with reference to Table 2.

The 5 g thermite/ZnCl2 solution mixture was combined with 0.2 g of an 85% by weight iron and potassium perchlorate mixture (e.g., 85% iron and 15% potassium perchlorate). Approximately 1 g of dry thermite mixture was added to the 5 g thermite/ZnCl2 solution mixture and the 0.2 g of the 85% by weight iron and potassium perchlorate mixture, which may also be referred to as the starter mixture.

In the experiment, the starter mixture was introduced to the thermite/ZnCl2 solution mixture.

A nichrome wire (e.g., NiCr, nickel-chrome, chrome-nickel, etc.) was placed in contact with the starter mixture to stimulate ignition of the starter mixture. Using the nichrome wire, an electric current was applied to the starter mixture. As may be appreciated, the starter mixture ignited and burned in each iteration of the ignition experiment as shown in the right most column of Table 2. The ignition experiments demonstrated that the ignitability of the thermite/ZnCl2 solution mixture is dependent on the volume fraction of thermite (e.g., the solid volume fraction) in the thermite/ZnCl2 solution mixture.

As with the thermite/ZnBr2 solution, the ignition experiments demonstrated that when the thermite/ZnCl2 solution included a solid volume fraction greater than 0.3, complete combustion of the mixture was observed as demonstrated by Rows 3-5 of Table 2. In comparison, when the thermite/ZnCl2 solution included a solid volume fraction less than 0.3, only the starter mixture burned, as demonstrated by Row 1 of Table 2.

The physical appearance of the thermite-ZnCl2 solution mixture confirmed that certain volume fractions of thermites in the thermite-ZnCl2 solution mixture result in solutions that may be pumpable. That is, complete combustion of the thermite-ZnCl2 solution mixture was achieved when the solid volume fraction of thermite in the thermite-ZnCl2 solution mixture exceeded approximately 0.3. In contrast, when no salt solution was used, mixtures of thermite and water required a thermite volume fraction of 0.5 or more to achieve complete combustion. Moreover, these mixtures were crumbly powders, i.e. not pumpable.

TABLE 2

Physical Appearance and Ignition Observations of Thermite and 80 wt. % $ZnCl_2$ Solution Mixture

| Row | Mass of aluminum (g) | Mass of iron (III) oxide (g) | Volume of 80% w/w $ZnCl_2$ solution (mL) | Volume fraction of thermite | Physical Appearance of Thermite/Water Mixture | Ignition Experiment Observations |
|---|---|---|---|---|---|---|
| 1 | 1.25 | 3.75 | 3.2 | 0.27 | Pourable fluid | Only starter mixture burned |
| 2 | 1.25 | 3.75 | 3 | 0.28 | Pourable fluid | Complete combustion of thermite/80% $ZnCl_2$ mixture |
| 3 | 1.25 | 3.75 | 2.5 | 0.32 | Thin paste, pumpable | Complete combustion of thermite/80% $ZnCl_2$ mixture |
| 4 | 1.25 | 3.75 | 2.0 | 0.37 | Thin paste, pumpable | Complete combustion of thermite/80% $ZnCl_2$ mixture |
| 5 | 1.25 | 3.75 | 1.4 | 0.44 | Sticky powder | Complete combustion of thermite/80% $ZnCl_2$ mixture |

It may be appreciated that the presence of certain salts (e.g., chlorine and bromine) in saturated salt solutions may react with certain thermite components (e.g., aluminum) that may contribute to the heat generated and distributed in the carrier fluid such that thermite reactions continue to propagate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method for initiating chemical reactions in a wellbore, comprising:

delivering two or more reactive components via a carrier fluid to the wellbore, wherein one or more chemical reactions of the two or more reactive components within the wellbore are configured to cause initiation of one or more additional chemical reactions of the two or more reactive components within the wellbore, thereby causing the carrier fluid to expand and cause one or more fractures in the wellbore;

determining whether a threshold volume of the two or more reactive components has been delivered to the wellbore; and in response to determining that the threshold volume of the two or more reactive components has not been delivered to the wellbore, continue delivering the two or more reactive components to the wellbore; or in response to determining that the threshold volume of the two or more reactive components has been delivered to the wellbore, causing delivery of the two or more reactive components to the wellbore to cease.

2. The method of claim 1, wherein the carrier fluid delivered to the wellbore comprises a salt solution.

3. The method of claim 2, wherein the salt solution is a saturated salt solution.

4. The method of claim 3, wherein the saturated salt solution comprises a mixture of thermite and a saturated zinc-halide solution.

5. The method of claim 4, wherein the mixture of the thermite and the saturated zinc-halide solution comprises 80% zinc-bromide by weight.

6. The method of claim 1, further comprising:

injecting the carrier fluid with one or more dispersants configured to increase the pumpability of the carrier fluid.

7. The method of claim 1, wherein the one or more additional chemical reactions comprise a thermite reaction.

8. The method of claim 1, wherein the one or more chemical reactions comprise one or more reactions between a metal and an oxidizer.

9. The method of claim 1, wherein the one or more chemical reactions comprise one or more reactions between a non-metallic fuel and an oxidizer.

10. The method of claim 1, wherein the one or more chemical reactions comprise one or more reactions between a water-sensitive metal and water.

11. The method of claim 1, wherein heat generated by the one or more chemical reactions within the wellbore are configured to cause initiation of the one or more additional chemical reactions within the wellbore.

12. The method of claim 1, wherein the two or more reactive components comprise at least one encapsulated reactive component.

* * * * *